United States Patent [19]

Nishikawa et al.

[11] 4,264,184

[45] Apr. 28, 1981

[54] OZONE REMOVING DEVICE FOR ELECTROGRAPHIC APPARATUS

[75] Inventors: Masaji Nishikawa; Hiroshi Furuhashi; Heiji Ogino, all of Hachioji, Japan

[73] Assignee: Olympus Optical Co., Ltd.

[21] Appl. No.: 51,423

[22] Filed: Jun. 25, 1979

Related U.S. Application Data

[63] Continuation of Ser. No. 859,113, Dec. 8, 1977, abandoned.

[30] Foreign Application Priority Data

Dec. 24, 1976 [JP] Japan ..... 51-155071

[51] Int. Cl.[3] ..... G03G 15/00

[52] U.S. Cl. ..... 355/3 R; 355/3 SC; 355/15

[58] Field of Search ..... 355/3 R, 3 SC, 14, 3 DR, 355/3 O, 3 CH, 15

[56] References Cited

U.S. PATENT DOCUMENTS

| | | | |
|---|---|---|---|
| 3,914,046 | 10/1975 | Tanaka et al. | 355/15 |
| 3,936,184 | 2/1976 | Tanaka et al. | 355/15 |
| 4,040,731 | 8/1977 | Nishikawa | 355/3 SC |

FOREIGN PATENT DOCUMENTS

| | | | |
|---|---|---|---|
| 1396618 | 6/1975 | United Kingdom | 355/3 R |

*Primary Examiner*—Richard L. Moses
*Attorney, Agent, or Firm*—Haseltine and Lake

[57] ABSTRACT

An ozone removing device for electrographic apparatus comprising a photosensitive screen and a corona discharge device for producing a harmful ozone is disclosed. The device comprises a casing substantially hermetically surrounding said photosensitive screen, an air circulating device for circulating an air stream through said corona discharge device in said casing and a catalyst device arranged in said air circulating device and for decomposing ozone produced from said corona discharge device, whereby said ozone is sucked into the outside of said casing by means of said air circulating device and decomposed and then flowed back into said casing again.

2 Claims, 2 Drawing Figures

OZONE REMOVING DEVICE FOR ELECTROGRAPHIC APPARATUS

This is a continuation of application Ser. No. 859,113 filed Dec. 8, 1977, now abandoned.

BACKGROUND OF THE INVENTION

1. Field of the Invention

This invention relates to an ozone removing device for electrographic apparatus comprising a photosensitive screen with a first electrostatic latent image produced thereon and a dielectric coated record medium with a second electrostatic latent image produced thereon by modulating a flow of corona ions by the first electrostatic latent image produced on the photosensitive screen.

2. Description of the Prior Art

Various types of the above mentioned electrographic apparatus have heretofore been proposed. One of the difficult problems which has been encountered with the case of practicing such electrographic apparatus consists in that ozone is produced from a corona discharge device which functions to uniformly charge the photosensitive screen and to transfer the first electrostatic latent image produced on the photosensitive screen onto a dielectric coated record medium as a second electrostatic latent image. That is, the ozone produced from the corona discharge device is not only harmful to a person, particularly to his respiratory organs but also tends to deteriorate a photosensitive layer of the photosensitive screen.

Many attempts have heretofore been made to remove such troubles due to the ozone, but none has led to fully satisfactory results. Conventional ozone removing device is intended to suck the ozone into the electrographic apparatus and to deliver the decomposed ozone outside of the electrographic apparatus. As a result, a much amount of air containing dust must be introduced into the photosensitive screen portion inclusive of the corona discharge device. In this case, there is a risk of the photosensitive screen being adhered with the dust contained in the air and hence deteriorated in its ability.

SUMMARY OF THE INVENTION

An object of the invention, therefore, is to provide an ozone removing device for electrographic apparatus which can prevent introduction of air containing dusts etc. into a photosensitive screen portion inclusive of a corona discharge device and which can effectively remove ozone produced from the corona discharge device.

A feature of the invention is the provision in an ozone removing device for electrographic apparatus comprising a photosensitive screen, at least one corona discharge device for producing, on the photosensitive screen, a first electrostatic latent image and means for modulating a flow of corona ions directed from the corona discharge device toward a dielectric coated record medium and producing, on the dielectric coated record medium, a second electrostatic latent image, of the improvement comprising an ozone removing device comprising a casing for substantially hermetically surrounding said photosensitive screen, an air circulating device for circulating an air stream through said corona discharge device in said casing and a catalyst device arranged in said air circulating device and for decomposing ozone produced from said corona discharge device, whereby said ozone is sucked into the outside of said casing by means of said air circulating device and decomposed and then flowed back into said casing again.

The invention will now be described in greater detail with reference to the accompanying drawings.

DESCRIPTION OF THE PREFERRED EMBODIMENTS

Figure 1:
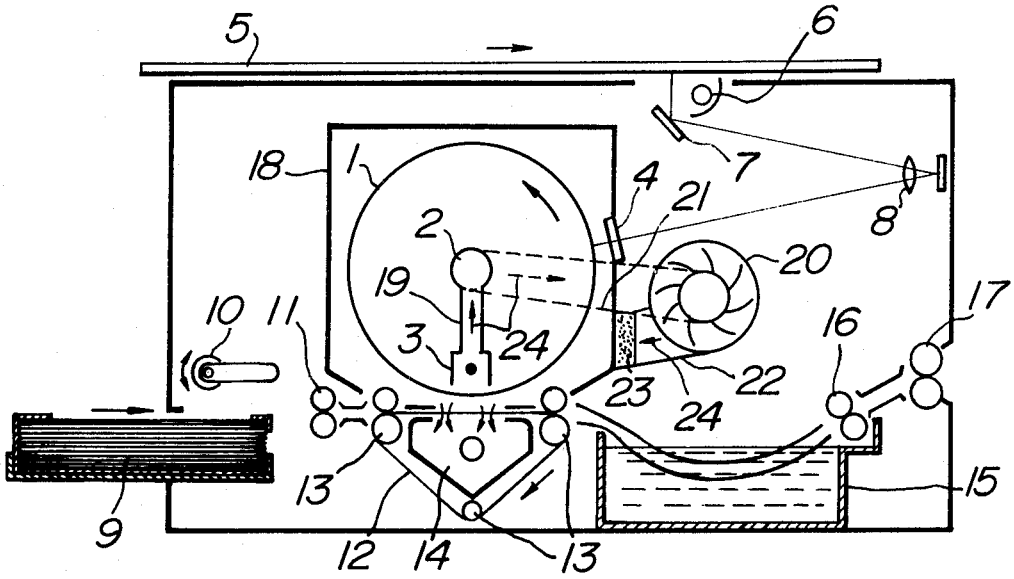
FIG. 1 is a diagrammatic cross-sectional view of one embodiment of an ozone removing device for electrographic apparatus according to the invention.

In FIG. 1 is shown one embodiment of an ozone removing device for electrographic apparatus according to the invention. In the present embodiment, use is made a drum-shaped photosensitive screen 1. The photosensitive screen drum 1 is rotatably supported by a fixed shaft 2 and rotated at a constant speed in a direction shown by an arrow by means of a suitable driving mechanism (not shown). At first, the photosensitive screen drum 1 is uniformly charged with a given polarity by means of a corona discharge device 3 arranged in the photosensitive screen drum 1 and arrives at a position opposed to a light transmitting window 4.

A manuscript (not shown) placed on a manuscript carriage 5 is illuminated by a light emitted from an illumination lamp 6 and the light reflected from the manuscript passes from a mirror 7 through an inmirror lens 8 to the light transmitting window 4, and then incident on the photosensitive screen drum 1. As a result, the uniform electric charge produced on the photosensitive screen drum 1 is subjected to that change which corresponds to the light image, thereby producing a first electrostatic latent image. The photosensitive screen drum 1 is further rotated. On the one hand, a feed roller 10 functions to pick up a dielectric coated record medium, for example, record sheet from a paper cassette 9 and deliver it one by one to a conveyor belt 12, which then feeds the dielectric coated record sheet placed thereon to the right at a constant speed. The conveyor belt 12 is driven by three driving rollers 13. The conveyor belt 12 is spaced apart from the photosensitive screen drum 1 by a given distance. As a result, the photosensitive screen drum 1 is rotated with its peripheral surface spaced apart from the dielectric coated record sheet fed by the conveyor belt by the given distance. In this case, a flow of corona ions having a polarity which is opposite to that of the uniform electric charge produced on the screen drum 1 is directed from the corona discharge device 3 through the openings of the screen drum 1 toward the dielectric coated record sheet. The flow of corona ions is modulated by the electrostatic charge produced on the screen drum 1, that is, the first electrostatic latent image to produce, on the dielectric coated record sheet, an electrostatic charge corresponding to the first electrostatic latent image, that is, a second electrostatic latent image. In the case of producing, on the dielectric coated record sheet, the second electrostatic latent image, the dielectric coated record sheet is subjected to a suction force of a suction box 14 arranged inside of the conveyor belt 12 and effectively held by the conveyor belt 12. Then, the dielectric coated record sheet is fed to a developing device 15 which converts an invisible image to a visible image. A surplus developing liquid is removed from the dielectric coated record sheet with the aid of squeezing rollers 16 and absorption rollers 17 and the dielectric coated record sheet is then dried into a final copy which is delivered to the outside of the electrographic apparatus. The above described operations are repeatedly effected while rotating the photosensitive screen drum 1.

In accordance with the invention, the photosensitive screen drum 1 is substantially hermetically surrounded by a casing 18. The fixed shaft 2 is made hollow and communicated through a suitable supporting member 19 with the corona discharge device 3 so as to permit air to flow from the corona discharge device 3 to the hollow shaft 2. In addition, a blower 20 is arranged outside of the casing 18 and connected through a suitable pipe 21 to the hollow fixed shaft 21 so as to permit the blower 20 to suck harmful gases such as ozone etc. thereinto. In addition, the harmful gas sucked into the pipe 21 by means of the blower 20 is flowed back through a duct 22 connecting the casing 18 to the blower 20 and an ozone decomposing filter 23 arranged in the duct 22 into the casing 18 again. The ozone decomposing filter 23 may be located in the hollow supporting member 19, hollow fixed shaft 2, connection pipe 21 or an air passage 24 composed of the duct 22 communicated with the blower 20.

The harmful gases such as ozone etc. produced near the corona discharge device 3 is sucked from the casing 18 into the air passage 24 by means of the blower 20 and decomposed by the ozone decomposing filter 23 and then flowed back into the casing 18 again. As a result, there is no risk of air containing dust etc. being penetrated from the outside into the casing 18, thereby effectively eliminating deterioration of the ability of the photosensitive screen drum 1 due to adherence of dust thereto and bad influence upon a person due to harmful ozone.

As means for decomposing ozone, use may be made of laminated catalyst particles formed of palladium carbon, platinum carbon etc.; a spongy substance covered with fine powders; a particle-shaped substance covered with catalyst substance; fine powders adhered to the surface of blades of the blower 20 etc. Experimental tests have yielded the result that the above mentioned means for decomposing ozone can easily decompose the ozone produced from the corona discharge device 3 to the order between 1/5 and 1/10.

The ozone removing effect of the ozone removing device according to the invention serves to prevent the characteristics of the photosensitive screen from being changed.

Such ozone removing effect is significantly exhibited with respect not only to a photosensitive screen mainly composed of selenium but also to a photosensitive screen composed of a selenium layer covered with a thin film formed of organic insulating material for the purpose of improving various kinds of characteristics thereof.

If the photosensitive screen composed of the selenium layer covered with the thin film formed of polyurethane, for example, was used for several thousands of times without decomposing ozone, deterioration such as dark decay etc. was observed. On the contrary, the use of the ozone removing device according to the invention provides the advantage that the same order of deterioration as in the case of without decomposing ozone was observed only after the photosensitive screen has been used for several tens of thousands.

In addition, experimental tests have demonstrated the result that if the ozone is removed, but the air stream after the decomposition of ozone is not flowed back into the casing, the deterioration of the photosensitive screen due to ozone is not observed, but dust etc. entered from the outside into the casing is adhered to the photosensitive screen, so that the surface resistance of the photosensitive screen becomes degraded, thereby increasing the dark decay and rendering a record picture rough to the touch, and that this tendency becomes conspicuous under a high humidity condition.

Figure 2:
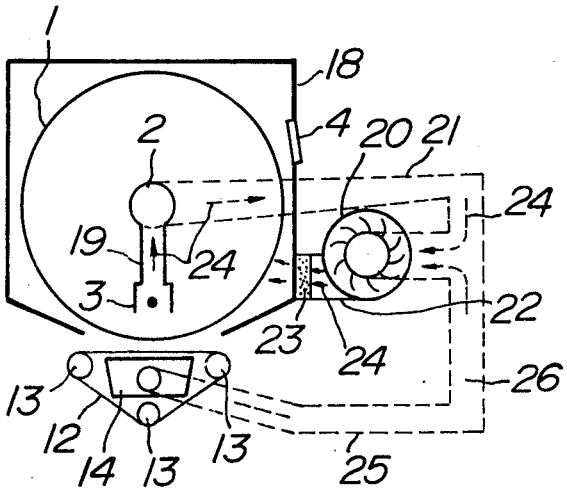
FIG. 2 is a diagrammatic cross-sectional view of another embodiment of an ozone removing device for electrographic apparatus according to the invention.

In FIG. 2 is shown another embodiment of an ozone removing device for electrographic apparatus according to the invention. In FIG. 2, the same reference numerals as those shown in FIG. 1 designate the same members as those shown in FIG. 1. In the present embodiment, the blower 20 for sucking the ozone produced from the corona discharge device 3 when the second electrostatic latent image is produced on the dielectric coated record sheet is also used as a blower for producing the sucking force in the suction box 14 for the purpose of effectively holding the dielectric coated recored sheet on the conveyor belt 12. For this purpose, the suction box 14 is connected through a suitable duct 25 to the blower 20 shown in FIG. 1 so as to form a second air passage 26 between the suction box 14 and the blower 20. Similar to the embodiment shown in FIG. 1, the ozone decomposing filter 23 may be located in the hollow supporting member 19, hollow fixed shaft 2, connection pipe 21 or the air passage 24 composed of the duct 22 communicated with the blower 20.

The use of the ozone removing device according to the invention also as the means for producing the suction force in the suction box 14 for the purpose of flowing back the sucked air stream into the casing 18 provides the important advantage that harmful gases such as ozone etc. can be removed, that the air containing dust etc. can effectively be prevented from being entered into the casing, and that it is possible to provide an electrographic apparatus which is simple in construction, small in size and less expensive.

As stated hereinbefore, in accordance with the invention, a photosensitive screen is surrounded by a casing, ozone produced near a corona discharge device is sucked out of the casing and subjected to decomposition treatment and the air stream sucked out of the casing is flowed back again into the casing. As a result, there is no risk of the inside of the casing being subjected to a negative pressure and hence the air containing dust etc. is prevented from being entered into the casing. In addition, since the gas flowed back into the casing does not contain ozone, no diterioration of the photosensitive screen occurs whereby it is possible to make the life of the photosensitive screen long. Moreover, there is no risk of a small room being impregnated with a bad smell of ozone which has been encountered with the prior art techniques.

The invention is not limited to the above described embodiments only, but various changes and modifications may be made. For example, in the above described embodiment, the ozone removing device according to the invention is applied to an electrographic apparatus comprising a screen drum 1 and one corona discharge device 3 arranged inside of the screen drum 1, and for uniformly charging the screen drum and producing, on a dielectric coated record sheet, a second electrostatic latent image. The ozone removing device according to the invention may also be applied to an electrographic apparatus comprising two corona discharge devices one of which functions to uniformly charge the screen drum and the other functions to produce, on the dielectric coated record sheet, the second electrostatic latent image. The ozone removing device according to the invention may also be applied to an electrographic apparatus comprising two corona discharge devices arranged inside and outside of the photosensitive screen drum 1, respectively. In addition, the ozone removing device according to the invention may be applied to an electrographic apparatus comprising a sheet-shaped photosensitive screen. In the embodiments shown in FIGS. 1 and 2, the corona discharge device 3 comprises a shield which is provided at its upper end surface opposed to a corona discharge wire with an opening which is communicated with the hollow fixed shaft 2. The shield of the corona discharge device 3 may also be provided at its side surface with an opening which is communicated with the hollow fixed shaft 2. Alternatively, the shield of the corona discharge device 3 may be provided at both the upper end and side surfaces thereof with openings which are communicated with the hollow fixed shaft 2, respectively.

What is claimed is:

1. An improved electrographic apparatus comprising: a photosensitive screen, and at least one corona discharge device located along said photosensitive body, said discharge device being operative to uniformly charge said photosensitive screen and to transfer the first electrostatic latent image produced on said photosensitive screen onto a dielectric coated record medium as a second electrostatic latent image, the improvement comprising: providing an ozone removal device having a casing for substantially hermetically surrounding said photosensitive screen, an air circulating device for circulating an air stream through said corona discharge device in said casing being defined by a blower arranged outside said casing, a first duct means connecting an opening provided in a shield of said corona discharge device to said blower for attracting ozone containing air generated by said corona device and second duct means connecting said blower to said casing for circulating the air stream from said blower to said casing and for circulating air confined in said casing, and a catalyst device arranged in the air stream path of said air circulating device decompose said ozone.

2. An ozone removing device according to claim 1, further comprising: a conveyor belt for feeding said dielectric coated record medium formed of a dielectric coated record sheet; a suction box arranged in proximity to said conveyor belt and secured to a supporting frame of said conveyor belt; said suction box being adapted to draw and hold said conveyor belt with said dielectric coated record thereon, when said second electrostatic latent image is produced, and said air circulating device being in communication with said suction box.

* * * * *